US005800084A

United States Patent [19]

Sawada et al.

[11] Patent Number: 5,800,084

[45] Date of Patent: Sep. 1, 1998

[54] INK SHEET CARTRIDGE AND RECORDING APPARATUS USING THE INK SHEET CARTRIDGE

[75] Inventors: Hirohisa Sawada, Tokyo; Masakatsu Iwata; Keizo Sasai, both of Yokohama; Fumihiko Nakamura, Tokyo, all of Japan

[73] Assignee: Canon Kabushiki Kaisha, Tokyo, Japan

[21] Appl. No.: 297,514

[22] Filed: Aug. 29, 1994

Related U.S. Application Data

[63] Continuation of Ser. No. 799,202, Nov. 27, 1991, abandoned.

[30] Foreign Application Priority Data

| | | | |
|---|---|---|---|
| Nov. 29, 1990 | [JP] | Japan | 2-325523 |
| Dec. 13, 1990 | [JP] | Japan | 2-410109 |
| Dec. 13, 1990 | [JP] | Japan | 2-410110 |
| Jan. 14, 1991 | [JP] | Japan | 3-016027 |
| Jul. 15, 1991 | [JP] | Japan | 3-198287 |

[51] Int. Cl.[6] ..... B41J 35/28; B41J 33/14

[52] U.S. Cl. ..... 400/208; 400/232

[58] Field of Search ..... 400/207, 208, 400/208.1, 583, 584, 232, 235.1, 227.2; 347/215, 217, 218

[56] References Cited

U.S. PATENT DOCUMENTS

| | | | |
|---|---|---|---|
| 3,689,007 | 9/1972 | Kihara et al. | 242/336 |
| 4,008,490 | 2/1977 | Lemelson | 242/336 |
| 4,231,667 | 11/1980 | Behrendt et al. | 400/235.1 |
| 4,650,357 | 3/1987 | Sidvers et al. | 400/235.1 |
| 4,688,954 | 8/1987 | Hofmann | 400/208 |
| 4,770,554 | 9/1988 | Stout | 400/227.2 |
| 4,812,063 | 3/1989 | Kunimitsu et al. | 400/234 |
| 4,840,504 | 6/1989 | Chu et al. | 400/208 |
| 4,868,674 | 9/1989 | Nakamura et al. | 358/296 |
| 4,910,602 | 3/1990 | Sakuragi | 400/207 |
| 4,921,363 | 5/1990 | Nishihara et al. | 400/208 |
| 4,984,109 | 1/1991 | Yokoo | 242/336 |
| 5,011,310 | 4/1991 | Weichert | 400/207 |
| 5,016,834 | 5/1991 | Sato et al. | 242/336 |
| 5,179,390 | 1/1993 | Yokoyama et al. | 346/76 PH |
| 5,182,688 | 1/1993 | Chen | 242/336 |

FOREIGN PATENT DOCUMENTS

| | | | |
|---|---|---|---|
| 0355939 | 2/1990 | European Pat. Off. | 400/208 |
| 0360279 | 3/1990 | European Pat. Off. . | |
| 0360282 | 3/1990 | European Pat. Off. . | |
| 0365010 | 4/1990 | European Pat. Off. . | |
| 0381154 | 8/1990 | European Pat. Off. | 400/208 |
| 59-199279 | 11/1984 | Japan . | |
| 60-127181 | 6/1985 | Japan . | |

*Primary Examiner*—Stephen R. Funk

*Attorney, Agent, or Firm*—Fitzpatrick, Cella, Harper & Scinto

[57] ABSTRACT

There is disclosed an ink sheet cartridge loadable into a recording apparatus for performing the recording onto a recording sheet. The cartridge comprises a first winding member for winding an ink sheet of multi-print having the ink on a carrier, a second winding member for winding the ink sheet, an ink sheet conveying rotational body for applying a conveying force to the ink sheet, the ink sheet conveying rotational body being provided on the recording head downstream thereof in a direction of conveying the ink sheet, and a frame body for containing the first winding member, the second winding member and the ink sheet conveying rotational body.

22 Claims, 12 Drawing Sheets

INK SHEET CARTRIDGE AND RECORDING APPARATUS USING THE INK SHEET CARTRIDGE

This application is a continuation of application Ser. No. 07/799,202 filed Nov. 27, 1991 now abandoned.

BACKGROUND OF THE INVENTION

1. Field of the Invention

The present invention relates to an ink sheet cartridge containing an ink sheet and a recording apparatus using the ink sheet cartridge.

2. Related Background Art

Today, with the progress of information processing systems, various information processing equipments have been developed. Among these equipments, recording apparatuses such as facsimile terminal equipments or printers have been extensively used not only in offices, but also in homes of ordinary families.

In these facsimile terminal equipments, so-called thermal recording method using the thermosenstive sheet colored with the application of heat is generally adopted so as to make the equipment smaller, but recently, facsimile terminal equipments with the so-called thermal transfer recording method of using the ink sheet have been developed. For example, as shown in FIG. 1, an ink sheet 50 with the ink applied on a base film is wound around a supply reel 51 and a take-up reel 52 and loaded into a main body of the apparatus. And in recording, the ink sheet is conveyed with the rotation of a conveying roller 53*a* for rotatably driving the ink sheet 50 and a pinch roller 53*b*, and a recording sheet 54 is conveyed with a platen roller 55, whereby the recording is performed by causing a recording head 56 to be heated in accordance with an image signal.

The ink sheet 50 is generally a so-called one-time ink sheet which is disposed of after one time of recording, but in recent years, a so-called multi-print ink sheet allowing for multiple times of recording is widely used.

This multi-print ink sheet allows the recording by setting a conveying length 1 of the ink sheet below a conveying length L of the recording sheet 54 (L/1=n: n>1), when the recording of a record length L is continuously made on a recording sheet 54 (thereinafter referred to as the n-value conveyance). Thereby, it is known that the utilization efficiency of the ink sheet is increased n times that of the one-time ink sheet, so that a reduced running cost can be expected.

As the invention using this multi-print ink sheet, EP365010/1990 publication, and EP360279/1990 publication which discloses the stabilization of this conveyance are known.

However, when constructing this ink sheet as the cartridge, there is no invention which can at least make the recording to be stable, while achieving the miniaturization of the cartridge itself.

The present invention was achieved to resolve newly found problems by examining various conveying states associated with the thermal transfer sheet.

The present invention first noted the driving for conveyance of the ink sheet which have a large influence on the recording because it is thinner than the recording sheet.

The first problem which has been found herein is that the conveying mechanism (torque control for either take-up or supply, or speed varying means, etc.,) for preventing the failure of conveyance due to slackness of the ink sheet may be larger, causing the hindrance in accomplishing the smaller apparatus.

On a further examination, when using a single conveying roller having an important action in conveying the ink sheet, some improved points necessary to accomplish one or more objects as will be described later have been found in view of the background art of the present invention.

Now, specific background art systems will be described below.

As the first background system, an example concerning the "n-value conveyance" as previously described will be described in more detail.

The conveying speed v of the recording sheet 54 can be determined by the rotational peripheral speed of the platen roller 55 as shown in FIG. 1, while the conveying speed of the ink sheet 50 can be determined by the rotational peripheral speed of the conveying roller 53*a*. Thus, for example, a recording apparatus capable of making the three-time multi-print (the rotational peripheral speed of the conveying roller 53*a* is ⅓ v as compared with that of the platen roller 55) allows only the three-time multi-print ink sheet (n-value=3) to be used. That is, with that recording apparatus, the three-time multi-print can be only used even if there is a ten-time multi-print ink sheet.

Thus, to resolve such disadvantages and allow for the recording in accordance with the n-value of the multi-print ink sheet, there is provided a sensor for detecting the n-value of the multi-print ink sheet, thereby allowing the rotational peripheral speed of the conveying roller 53*a* to be varied in accordance with a signal from the sensor. However, there is a problem that this conventional design using the sensor makes the apparatus complex and large, and may increase the cost.

As the second background system, the ink sheet conveying state and the larger size of the apparatus will be described. When the ink sheet 50 is conveyed with the conveying roller 53*a* and the pinch roller 53*b*, as previously described, there is a disadvantage that the ink may adhere to the pinch roller 53*b* in contact with an ink applied face of the ink sheet 50, or the ink may drop within the inside of the apparatus.

In order to convey the ink sheet 50 without slippage, it is preferable that the conveying roller 53*a* has a high friction coefficient, and the ink sheet 50 has a large contact angle around the roller 53*a*. However, conventionally, the ink sheet 50 is taken up with the ink face of the ink sheet facing outward on the take-up reel, as shown in FIG. 1. Accordingly, in taking up the ink sheet 50, the contact angle becomes smaller when the take-up reel is larger in diameter.

To have a sufficient contact angle of the ink sheet 50 with respect to the conveying roller 53 in a state where the ink sheet 50 has been all taken up, it is necessary that the take-up reel 52 is located upward, or the conveying roller 53*a* and the pinch roller 53*b* are located downward. However, a problem arises that the apparatus is larger in height.

Also, the larger size of apparatus may be brought about by the use of a single conveying roller, regardless of the contact angle. As the third background system, a point corresponding to the first problem as above described will be described.

When the ink sheet 50 is taken up, a load (back tension) of about 700 g·cm to 1500 g·cm is given to the rotation of the supply reel 51 so as to prevent the slack of the ink sheet from occurring.

The constitution for giving the back tension is such that a cover member is openably secured onto a main body of the recording apparatus and loaded with an ink cartridge with the supply reel 51 and the take-up reel 52 contained therein. The supply reel 51 has a reel gear mounted, which is mated with a pendulum gear provided in the main body of the apparatus, if the cover member is closed. This pendulum gear has a slip clutch mounted to give a certain rotational load to the rotation of the reel gear.

However, with the constitution of giving the back tension, the reel gear must be provided on the supply reel 51, and the pendulum gear for mating with the reel gear must be provided on the side of the apparatus main body, so that the number of parts may be increased.

Also, a space is necessary for providing the pendulum gear and the slip clutch in the main body of the apparatus, thereby causing an obstacle in making the apparatus as small as possible.

Furthermore, there is a problem that as the back tension is given at more than one stage, irregular action may arise in transmitting the torque load, and is likely to cause a non-uniform image.

Furthermore, the ink sheet 50 conveyed with the conveying roller 53*a* and the pinch roller 53*b* is taken up into the take-up reel 52, in which a rotational force having a slightly faster peripheral speed than the conveying speed of the ink sheet 50 is transmitted via a slide clutch to the take-up reel 52. Thereby, the ink sheet 50 to be conveyed is prevented from slackening, and giving the front tension.

However, conventionally, since a slide clutch unit which has means for transmitting a certain rotational torque to the take-up reel 52 was provided on the side of the apparatus main body, a space was needed for providing the slide clutch unit on the main body of the apparatus. Owing to the constitution for transmitting a driving force to the conveying roller 53*a*, the disposing position of the slide clutch was often limited, giving an adverse effect on the assembly.

Furthermore, the improvement of the durability of the slide clutch was necessary depending on the service frequency of the recording apparatus, thereby increasing the cost.

As the fourth background system, an instance where the ink sheet and the recording sheet are conveyed in mutually opposite directions in the recording area of the thermal recording head (hereinafter referred to as an opposite direction conveyance) will be described below.

In this opposite direction conveyance, since the ink sheet is conveyed in an opposite direction to the recording sheet, the conveying load with the ink in the recording area where the thermal transfer recording has been performed may bring about the failure of conveyance for the ink sheet.

The present invention has come about after having examined a conveying direction of the ink sheet from the recording area, the surface characteristics of the single conveying roller as previously described, and the minimum contact angle of the ink sheet relative to the conveying roller in order to prevent the failure of conveyance.

SUMMARY OF THE INVENTION

It is a first object of the present invention to provide an ink sheet cartridge detachable from a recording apparatus having any one of a single ink sheet conveying rotational body for mainly controlling at least the conveyance of an ink sheet, torque affording means provided within a rotation shaft of a first winding member as an ink supply member, and torque affording means provided within a rotation shaft of a second winding member as an ink take-up member, within the ink sheet cartridge.

It is a second object of the present invention to provide an ink sheet cartridge loadable into a recording apparatus for performing the recording onto a recording sheet, using a recording head, comprising:

a first winding member for winding an ink sheet of multi-print having the ink on a carrier;

a second winding member for winding said ink sheet;

an ink sheet conveying rotational body for affording a conveying force to said ink sheet, said ink sheet conveying rotational body being provided on said recording head downstream thereof in the direction of conveying said ink sheet; and a frame body for containing said first winding member, said second winding member and said ink sheet conveying rotational body;

wherein said ink sheet is wound around said second winding member rotating in an opposite direction to a rotational direction of said ink sheet conveying rotational body via said ink sheet conveying rotational body provided on the side of said recording head for said ink sheet;

wherein said ink sheet has an inclination of less than 5° relative to a tangent direction of an action portion of said recording head acting on said ink sheet;

wherein said ink sheet is placed in contact with an external peripheral face of said ink sheet conveying rotational body at a contact angle from 5° to 180°;

wherein the action portion of said recording head acting on said ink sheet is provided in the vicinity of an edge of an action face where said action portion exists downstream thereof in the direction of conveying said ink sheet; and wherein assuming that the diameter of said ink sheet conveying rotational body is D mm, the rotational angular velocity of said ink sheet conveying rotational body is R rad/sec, and the conveying length of said ink sheet in recording is 1/n the conveying length L mm/sec of said recording sheet in recording, there is a relation of $D=2\ L/nR$.

It is a third object of the present invention to provide an ink sheet cartridge loadable into a recording apparatus for performing the recording onto a recording sheet, using a recording head, comprising:

a first winding member for winding an ink sheet of multi-print having the ink on a carrier;

a second winding member for winding said ink sheet;

an ink sheet conveying rotational body for affording a conveying force to said ink sheet, said ink sheet conveying rotational body conveying said ink sheet in a different direction from that of said recording sheet in a recording area; and a frame body for containing said first winding member, said second winding member and said ink sheet conveying rotational body;

wherein said ink sheet is wound around said second winding member rotating in an opposite direction to a rotational direction of said ink sheet conveying rotational body via said ink sheet conveying rotational body provided on the side of said recording head for said ink sheet.

It is a fourth object of the present invention to provide an ink sheet cartridge loadable into a recording apparatus for performing the recording onto a recording sheet, using a recording head, comprising:

a first winding member for winding an ink sheet of multi-print having the ink on a carrier;

a second winding member for winding said ink sheet;

an ink sheet conveying rotational body for affording a conveying force to said ink sheet, said ink sheet conveying rotational body conveying said ink sheet in a different direction from that of said recording sheet in a recording area; and a frame body for containing said first winding member, said second winding member and said ink sheet conveying rotational body;

wherein the action portion of said recording head acting on said ink sheet is provided in the vicinity of an edge of an action face where said action portion exists downstream thereof in the direction of conveying said ink sheet.

It is a fifth object of the present invention to provide an ink sheet cartridge loadable into a recording apparatus for performing the recording onto a recording sheet, using a recording head, comprising:

a first winding member for winding an ink sheet of multi-print having the ink on a carrier;

a second winding member for winding said ink sheet;

an ink sheet conveying rotational body for affording a conveying force to said ink sheet, said ink sheet conveying rotational body conveying said ink sheet in a different direction from that of said recording sheet in a recording area; and a frame body for containing said first winding member, said second winding member and said ink sheet conveying rotational body;

wherein assuming that the diameter of said ink sheet conveying rotational body is D mm, the rotational angular velocity of said ink sheet conveying rotational body is R rad/sec, and the conveying length of said ink sheet in recording is 1/n the conveying length L mm/sec of said recording sheet in recording, there is a relation of D=2 L/nR.

It is a sixth object of the present invention to provide an ink sheet cartridge loadable into a recording apparatus for performing the recording onto a recording sheet, using a recording head, comprising:

a first winding member for winding an ink sheet of multi-print having the ink on a carrier;

a second winding member for winding said ink sheet;

an ink sheet conveying rotational body for affording a conveying force to said ink sheet, said ink sheet conveying rotational body conveying said ink sheet in a different direction from that of said recording sheet in a recording area; and a frame body for containing said first winding member, said second winding member and said ink sheet conveying rotational body;

wherein said ink sheet is placed in contact with an external peripheral face of said ink sheet conveying rotational body at a contact angle from 45° to 180°.

DETAILED DESCRIPTION OF THE PREFERRED EMBODIMENTS

[EXAMPLE ]

Figure 1:
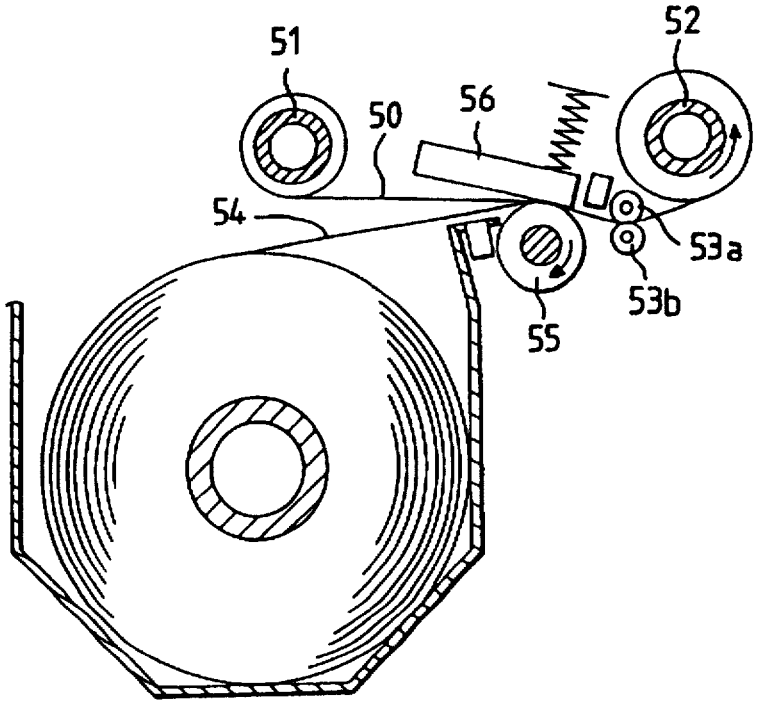
FIG. 1 PRIOR ART
FIG. 1 is an explanation view of a recording constitution in the conventional art.
Figure 2:
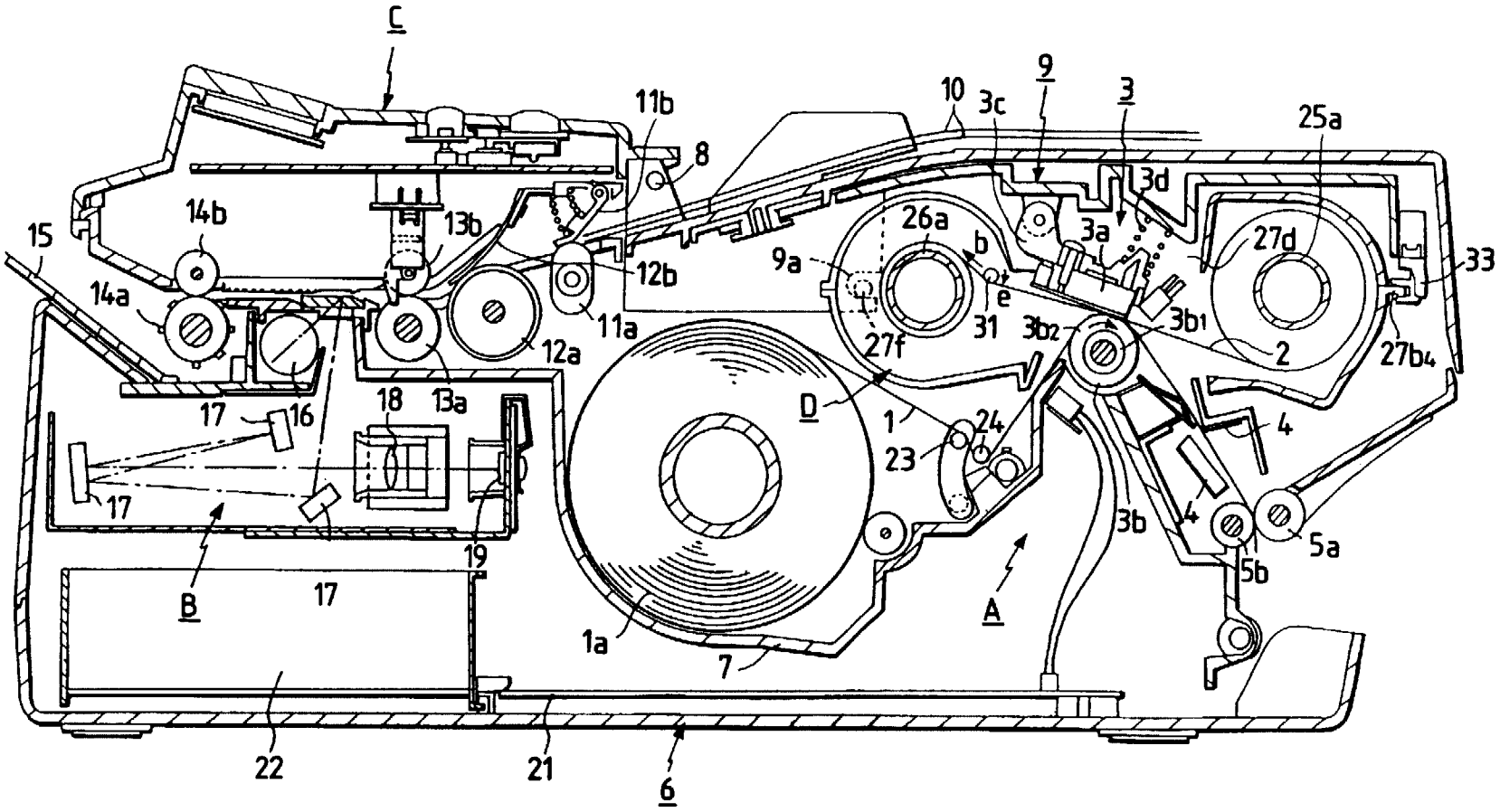
FIG. 2 is an explanation view for the entire structure of a facsimile equipment as a recording apparatus according to the present invention.
Figure 3:
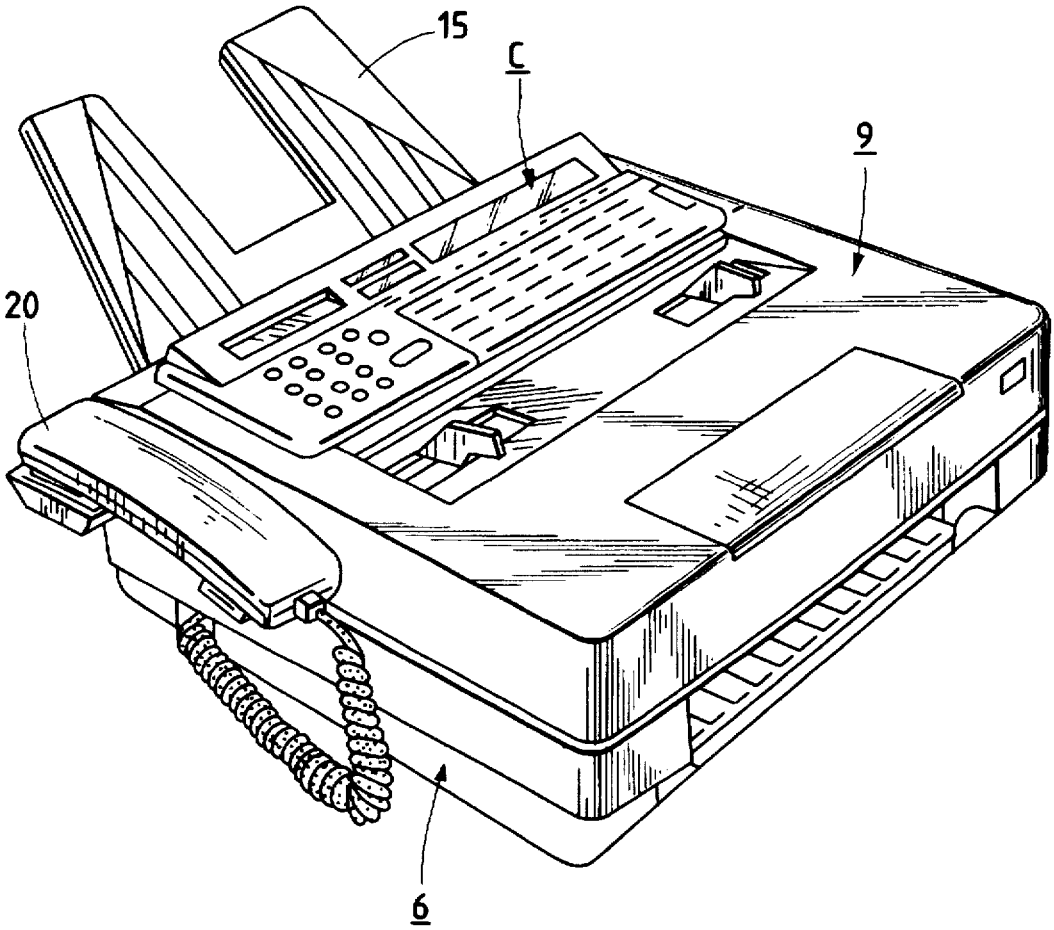
FIG. 3 is an external perspective explanation view.
Figure 4:
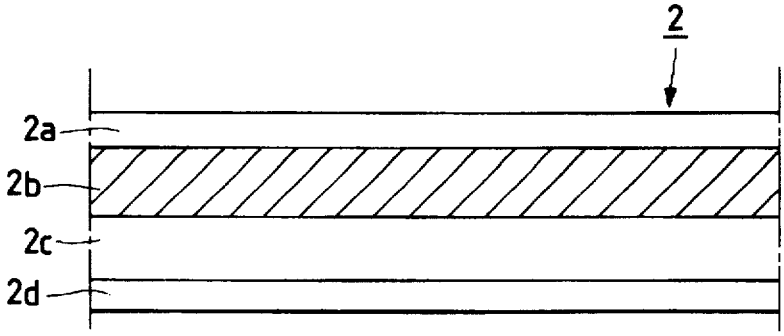
FIG. 4 is a cross-sectional explanation view of an ink sheet.
Figure 5:
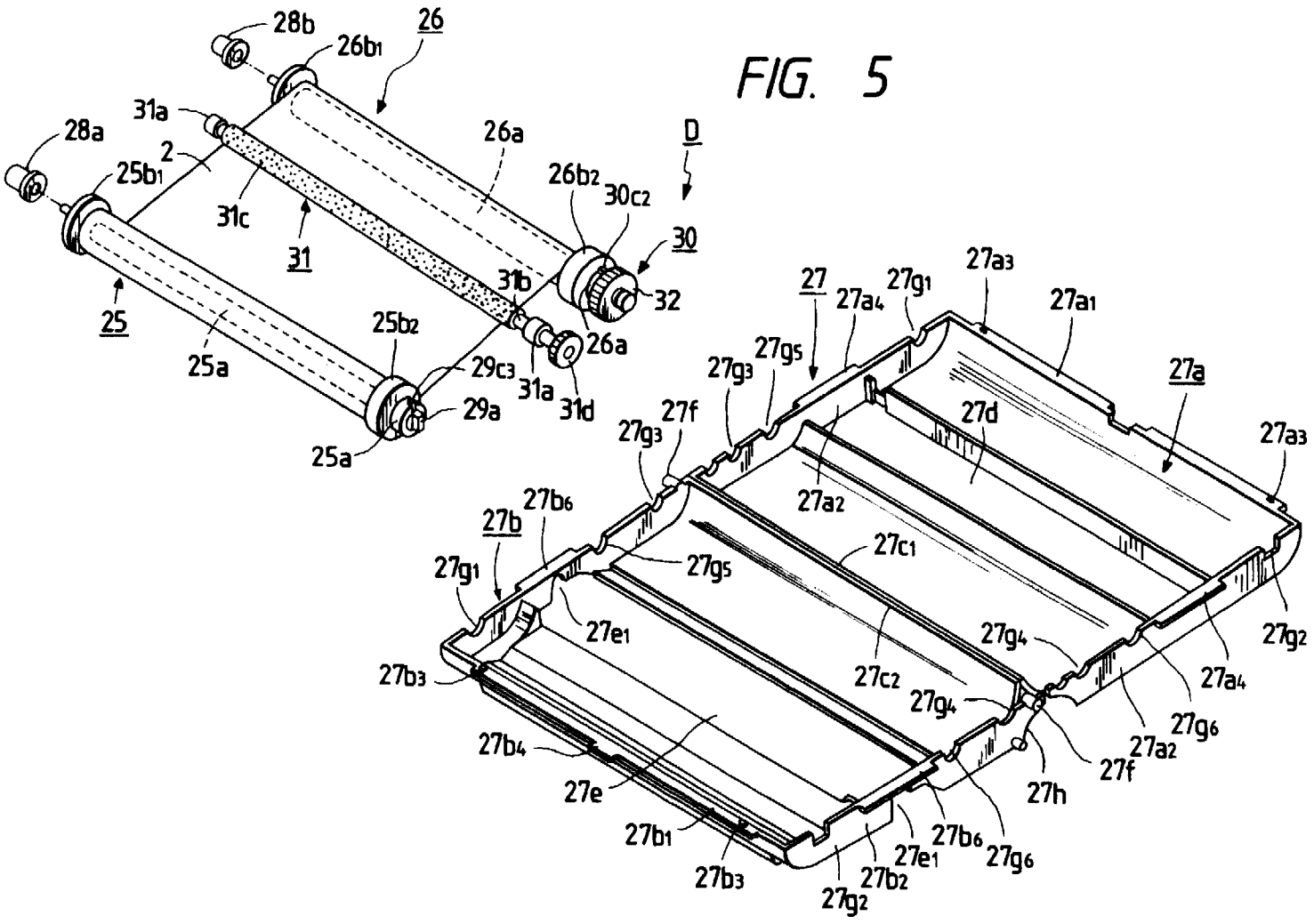
FIG. 5 is an expanded explanation-view of an ink sheet cartridge.

A recording apparatus A in this example is constituted as a recording system for a facsimile terminal equipment, wherein FIG. 2 is an explanation view of total construction for the facsimile terminal equipment, FIG. 3 is an external perspective explanation view, FIG. 4 is a cross-sectional explanation view of an ink sheet, and FIG. 5 is an expanded explanation view of an ink sheet cartridge. (General description of facsimile terminal equipment)

Firstly, the total constitution of facsimile terminal equipment will be described with reference to FIGS. 2 and 3.

This facsimile terminal equipment is constituted of a recording system A as a recording apparatus, a reading system B for reading an image represented in an original, an operation panel C, and an ink sheet cartridge D loaded therein, as shown in FIG. 2.

The recording system A records image onto a recording sheet 1, in accordance with an image signal transmitted from other terminals, or from the reading system B as will be described later. That is, the recording sheet 1 and the ink sheet 2 which are overlapped are pressed against a platen roller 3*b* by a recording head 3*a* constituting recording means 3.

Then, the recording sheet 1 is conveyed in a direction of arrow a with the rotation of the platen roller 3*b* in a direction of arrow as indicated in FIG. 2, while the ink sheet 2 is conveyed in a direction of arrow b by driving means as will be described later. The recording means 3 forms an image by heating the recording head 3*a* in accordance with the image signal and in synchronism with the conveyance of the recording sheet 1 and the ink sheet 2 so as to fuse (or sublimate) the ink applied on the ink sheet 2, and transferring fused ink to the recording sheet 1.

And the recording sheet 1 having a predetermined image formed thereon is further conveyed in the direction of arrow a, cut by a cutter 4, and conveyed by a pair of exhausting rollers 5*a*, 5*b* to exhaust it out of the apparatus.

The recording sheet 1 is contained in a roll holder 7 provided in an apparatus body 6, in which the roll holder 7, the platen roller 3b, the cutter 4, and the pair of exhausting rollers 5a, 5b are also provided.

Also, in this example, the ink sheet 2 is contained in an ink sheet cartridge D having a constitution as will be described later. This ink sheet cartridge D is detachably loaded into a recording cover 9 as a cover member rotatably affixed via a rotation axis 8 to the apparatus body 6. The recording head 3a is provided at a predetermined position of the recording cover 9.

On the other hand, the recording system B applies the light onto an original 10 and converts its reflected light into an electrical signal, which is transmitted to another equipment or its own recording system A in accordance with the operation mode.

That is, plural originals 10 are laid on an original setting board 9b formed on an upper surface of the recording cover 9, and preconveyed by means of a preliminary conveying roller 11a and a pressing bar 11b, and then separated into each one by a separation roller 12a and a contacting plate 12b for making contact thereon, in which its separated original 10 is further conveyed by a pair of conveying rollers 13a, 13b and a pair of exhausting rollers 14a, 14b to be exhausted to an exhaust tray 15. And while the original 10 is being conveyed, the original plane is illuminated from a light source 16, and its reflected light is led via mirrors 17 and a lens 18 to a photoelectric transducer 19 such as CCD, an image signal of which is transmitted to its own recording system in the copy mode, or to the recording system of other equipment in the transmission mode.

The operation panel C is a panel for allowing the operations such as mode switching operation, copy operation, and transmission operation, as shown in FIG. 3, and is provided with keys corresponding to various operations. The operation panel C is provided on an upper portion of an original conveying mechanism in the reading system B, and rotatably attached to the apparatus body 6. It is noted that a telephone handset 20 for transmission and reception is mounted on one end side of the operation panel C.

In FIG. 2, 21 is a wiring substrate, and 22 is a power supply.

The constitution of each portion such as the recording system A and the ink cartridge D as above shown will be described specifically in the following.

(Recording sheet)

The recording sheet 1 is a plain paper or plastic sheet, or any other material onto which the ink can be transferred. In this example, long plain papers of B4 or A4 size are used as the recording sheet 1. And a sheet roll la having the recording sheet 1 wound as a roll is received in a roll holder 7 provided at a predetermined position (substantially central portion in FIG. 2) of the apparatus body 6.

As the recording sheet 1 is wound as the roll, there is a fear that some curls may occur. Thus, in order to remove such curls, there is provided a decurl shaft 23 near the platen roller 3b in the roll holder 7. The decurl shaft 23 rotates in accordance with the tensile force acting on the recording sheet 1 and in cooperation with a guide shaft 24 as will be described later, so as to remove curls on the recording sheet 1.

In this example, in order to reduce the running cost, the so-called multi-print method is adopted in which in recording, the conveyance speed of ink sheet 2 is made slower than that of recording sheet 1. This multi-print method is one in which the recording is performed with the conveyance length L of recording sheet 1 being is greater than the conveyance length l of ink sheet 2, i.e., $L/l=n>1$. In this way, the utilization efficiency of ink sheet 2 can be made n times that of a conventional recording method ($L/l=1$) in which the conveyance lengths for the recording sheet 1 and the ink sheet 2 are the same.

(Ink sheet)

The ink sheet 2 is constituted to allow n times of ink transfers to be performed at the same portion to permit the multi-print as previously described. For this purpose, in this example, it is composed of four layers which are a first layer of heat resisting coat layer 2a, a second layer of base film layer 2b, a third layer of ink layer 2c, and a fourth layer of top coating layer 2d, as shown in FIG. 4.

The heat resisting coat layer 2a serves to protect a base film 2b from the heat of recording head 3a which is a thermal head. Though this heat resisting coat layer 2a is preferable to the multi-print in which the heat energy of n lines may be applied to the same portion (when heat information is consecutively given), whether or not this heat resisting coat layer 2a should be provided can be appropriately selected in accordance with the recording method. It is effective that the heat resisting coat layer 2a is provided on a base film with relatively low heat resistance such as a polyester film.

The second layer of base film layer 2b serves as a carrier for ink sheet 2, wherein in the multi-print, an aromatic polyamide film or condenser paper having a high heat resistance is preferable as the heat energy is applied multiple times at the same location, but a conventional polyester film is also usable. The thickness is preferably about 3 μm to 8 μm, because it should be as thin as possible from the viewpoint of print quality as the role of medium, but the strength must be considered.

The third layer of ink layer 2c is a layer containing the amount of ink allowing for n times of transfers in the recording sheet 1. The ink ingredients are a resin as the adhesive such as EVA, carbon black or nigrosine dye for the coloring, carnauba wax or paraffin wax as the binding material, etc., as the main component, and are blended so as to withstand n times of services at the same portion. The sensitivity or density can be varied with the application amount of this ink layer 2c, which can be arbitrarily selected, but is preferably 4 $g/m^2$ to 9 $g/m^2$.

Also, the fourth layer of top coating layer 2d is a non-recording portion to prevent the third layer of ink layer 2c from being transferred under pressure onto the recording sheet 1, and generally composed of a transparent wax. Thereby, it is only the transparent top coating layer 2d that is transferred under pressure onto the recording sheet 1 among non-recording portions, so that the recording sheet 1 is kept from being dirty on its surface.

It should be noted that the ink sheet 2 is not limited to the construction of this example, but for example, one comprising a base layer which is a carrier and a porous ink holding layer for containing the ink provided on one side of the base layer, or providing a heat resisting ink layer having a fine porous mesh structure on the base film and containing the ink can be used.

The material of the base film layer 2b may be a film or paper composed of polyimide, polyethylene, polyester, polyvinyl chloride, triacetylcellulose, and nylon, for example. Moreover, though the heat resisting coat layer 2a is not necessarily required, its material may be silicone resin, epoxy resin, fluorocarbon resin, or nitrocellulose, for example.

One example of the ink sheet 2 having the heat-sublimable ink is one in which a color material layer containing spacer grains formed of guanamine resin and fluorocarbon resin, as well as dye, is provided on a substrate formed of polyethylene terephthalate, polyethylene naphthalate, or aromatic polyamide film.

In this example, to facilitate the handling of the ink sheet 2, it is contained in the ink sheet cartridge D.

(Ink sheet cartridge)

A constitution of ink sheet cartridge D is such that a supply reel 25 which is a first winding member and a take-up reel 26 which is a second winding member are mounted at predetermined positions in a frame body 27, and the ink sheet 2 is loaded by passing under tension the ink sheet 2 wound around the supply reel 25 and around the take-up reel 26, as shown in FIG. 5. By using this ink sheet cartridge D, the ink sheet 2 can be loaded into the recording system A quite simply and surely in a stable state.

The ink sheet cartridge D is disposed of together with the ink sheet 2, if the ink sheet has been used up. That is, the ink sheet cartridge D is required to be supplied at low price owing to its disposability. Next, the constitution of each portion for the ink sheet cartridge D will be described more specifically.

(Frame body)

The frame body 27 in this example is formed of a first body 27*a* and a second body 27*b* which are ultrasonic welded. That is, it is constituted as shown in FIG. 5 in such a way that the weld zones 27*c*1, 27*c*2 which are connection portions between the first body 27*a* and the second body 27*b* are ultrasonic-welded, and the weld zones 27*a*1, 27*a*4 formed respectively on a substantially top end and a side end of the first body 27*a* and the weld zones 27*b*1, 27*b*6 formed respectively on a substantially top end and a side end of the second body 27*b* are ultrasonic-welded.

The weld zones 27*a*1, 27*b*1 and 27*c*1, 27*c*2 may be formed over the entire length, or formed intermittently with predetermined lengths in a width direction of ink sheet.

As a molding material of the frame-body 27, a resin such as polypropylene resin or ABS resin can be used.

In the frame body 27, a window 27*d* for inserting the recording head 3 is formed in a substantially central portion of the first body 27*a*, as shown in FIG. 5, and a window 27*e* for inserting the platen roller 3*b* is formed in a substantially central portion of the second body 27*b*, in which a notch 27*e*1 for a shank 3*b*1 (see FIG. 2) of the platen roller 3*b* to run off is formed continuously with that window 27*e*.

On both sides of the first body 27*a* and the second body 27*b* are vertically formed side plates 27*a*2, 27*b*2, respectively, and on the weld zones 27*c*1, 27*c*2 and the open sides are formed curved surfaces of quarter circle, respectively. On the weld zone 27*a*1 formed in a curved end portion on the open side of the first body 27*a*, a fit-in hole 27*a*3 is punched, and on the weld zone 27*b*1 formed in a curved end portion on the open side of the second body 27*b*, a fit-in projection 27*b*3 for fitting into the fit-in hole 27*a*3 is formed. Further, in a curved surface on the open side of the second body 27*b*is formed an interlock projection 27*b*4 for interlocking with a lock latch provided on the cover 9, in loading the ink sheet cartridge D into the recording cover 9.

At predetermined positions on both sides of the side plate 27*b*2 of the second body 27*b*are formed guide pins 27*f* serving as the guide in loading the ink sheet cartridge D into the recording cover 9.

Also, at predetermined positions of the side plates 27*a*2, 27*b*2 are formed a U groove 27*g*1 into which a bearing 28*a* attached to one end of the supply reel 25 is fitted, and a U groove 27*g*2 for securely fixing a shank 29*a* of the slide clutch 29 to be attached to the other end of the supply reel 25 as will be described later, respectively. Also, on the side plates 27*a*2, 27*b*2 are formed a U groove 27*g*3 into which a bearing 28*b* attached to one end of the take-up reel 26 is fitted, and a U groove 27*g*4 into which a shank 30*a* of the slide clutch 30 attached to the other end of the take-up reel 26 as will be described later is fitted. Further, on the side plates 27*a* 2, 27*b*2 are formed U grooves 27*g*5, 27*g*6 into which bearings 31*a* of a capstan roller 31 serving as the ink sheet conveying member as will be described later are fitted.

Furthermore, the second body 27*b* is formed with an opening 27*h* for exposing a reel gear 32 of the take-up reel 26.

(Supply reel and slide clutch)

The supply reel 25 is one around which the ink sheet 2 is wound. On both ends of the reel shaft 25*a* having a substantially same length as the width of the ink sheet 2 are provided flanges 25*b*1, 25*b*2, in which on one flange 25*b*1 side is mounted the bearing 28*a*, and on the other flange 25*b*2 side is mounted a slide clutch 29 which is rotational load affording means to the supply reel 25.

Figure 6A:
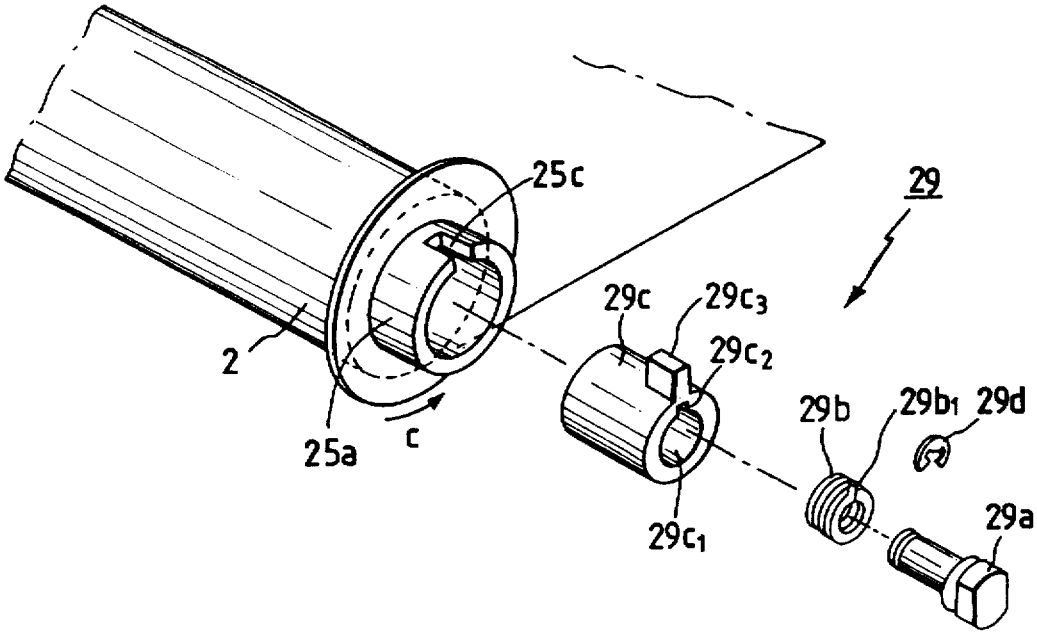
FIGS. 6A and 6B are constitutional explanation views of a slide clutch on the side of a supply reel.
Figure 6B:
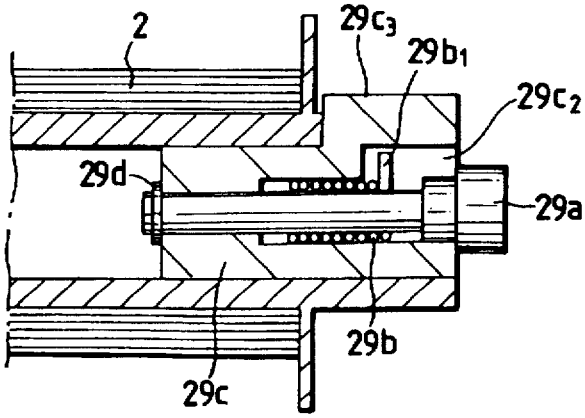

The slide clutch 29 is to afford a back tension to the ink sheet 2 pulled out from the supply reel 25. The constitution of the slide clutch 29 is such that a spring 29*b* is compressedly fitted through a shaft 29*a* having a head portion with both side faces cut away, as shown in an exploded view of FIG. 6A and a cross-sectional view of FIG. 6B, with a hook portion 29*b*1 formed on the spring 29*b*. The shaft 29*a* having the spring 29*b* mounted thereon is inserted into a through hole 29*c*1 of a collar 29*c*, with an E ring 29*d* being attached at a leading end of the shaft 29*a* for preventing the slippage. It is inserted so that the hook portion 29*b*1 of the spring 29*b* is fitted into a recess portion 29*c*2 formed in the through hole 29*c*1.

Furthermore, the collar 29*c* is inserted into a hollow reel shaft 25*a*, with a projection 29*c*3 projecting from an external periphery of the collar 29*c* being fitted into a rectangular groove 25*c* formed at an end portion of the reel shaft 25*a*.

In this constitution, if the ink sheet 2 is pulled out from the supply reel 25 mounted on the frame body 27, the supply reel 25 is rotated in the direction of arrow c as shown in FIG. 6 (the direction of pulling out the ink sheet 2). As the shaft 29*a* is in an unrotatable state because of being fitted into the square groove 27*g*2 of the frame body 27 at this time, the spring 29*b* which tightens the shaft 29*a* is subject to a rotational force in the direction of slacking, thereby causing a frictional load between an external periphery of the shaft 29*a* and an inner periphery of the spring 29*b*. With this frictional load, if the ink sheet 2 is subject to a conveying force and the supply reel 25 is subject to a rotational force above a predetermined torque, the spring 29*b* may slide around the external periphery of the shaft 29*a* due to that predetermined torque.

Accordingly, in pulling out the ink sheet 2 from the supply reel 25, a constant load is always applied so that the back tension is given to the ink sheet 2. Note that since the frictional load arising from the spring 29*b* which is subject to a rotational force in the direction of slacking is stable, a stable back tension is given to the ink sheet 2.

(Take-up reel and slide clutch)

The take-up reel 26 is one for taking up the ink sheet 2 pulled out from the supply reel 25. Like the supply reel 25 as previously described in FIG. 5, on both ends of the reel shaft 26*a* having a substantially same length as the width of the ink sheet 2 are provided flanges 26*b*1, 26*b*2, in which on one flange 26*b*1 side is mounted the bearing 28*b*, and on the other flange 26*b*2 side is mounted a slide clutch 30 which is rotational force limiting means.

The slide clutch 30 is to afford a fixed rotational torque to the take-up reel 26. The constitution of the slide clutch 30 is such that a spring 30*b* is compressedly fitted through a shank 30*a* having a D-cut fitting portion 30*a*1, as shown in an exploded view of FIG. 7A and a cross-sectional view of FIG. 7B, with a hook portion 30*b*1 being formed on the spring 30*b*. A reel gear 32 is fitted loosely with a play around the shank 30*a* having the spring 30*b* mounted thereon, and the shank 30*a* is inserted into a through hole 30*c*1 of a collar 30*c*, with E rings 30*d*, 30*e* being attached at both ends of the shank 30*a* for preventing the slippage. It is inserted so that the hook portion 30*b*1 of the spring 30*b* is fitted into a recess portion 32*a* formed in the reel gear 32.

Furthermore, the collar 30*c* is inserted into a hollow reel shaft 26*a*, with a projection 30*c*2 projecting from an external periphery of the collar 30*c* being fitted into a rectangular groove 26*c* formed at an end portion of the reel shaft 26*a*.

Figure 7A:
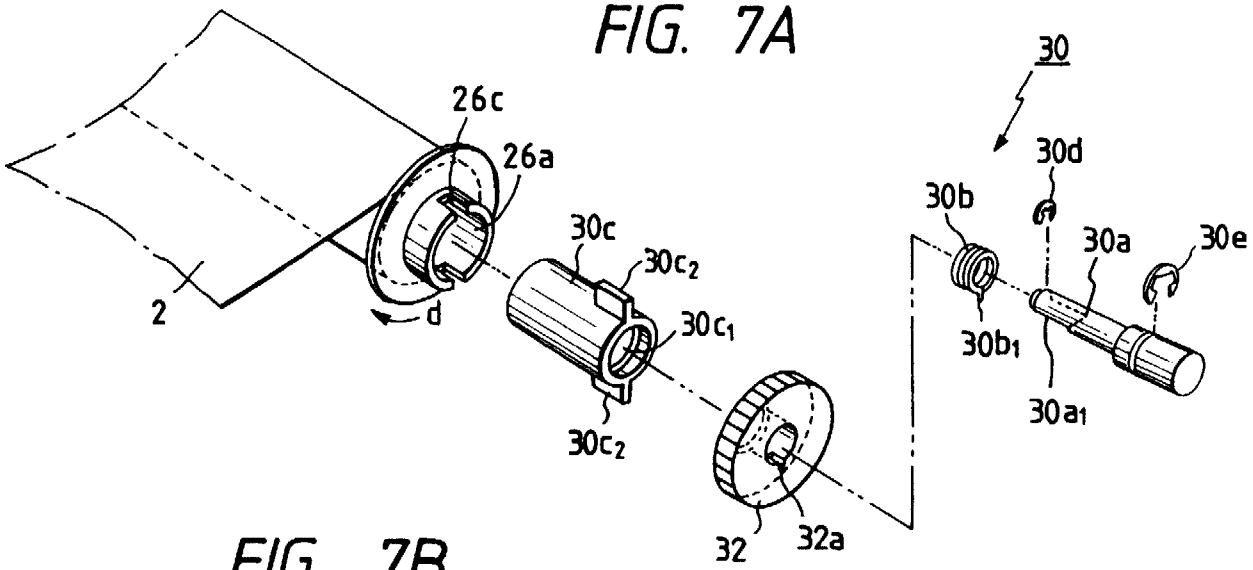
FIGS. 7A and 7B are constitutional explanation views of the slide clutch on the side of a take-up reel.
Figure 7B:
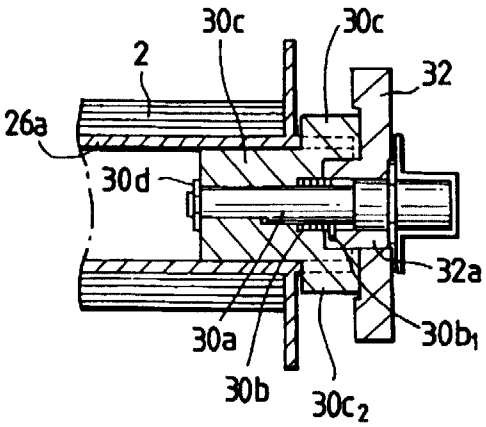

In this constitution, if the reel gear 32 is rotated in the direction of arrow d in FIG. 7A (the direction in which the take-up reel 26 winds the ink sheet 2), the spring 30*b* which tightens the shank 30*a* is subject to a rotational force in the direction of slacking, thereby causing a frictional load between an external periphery of the shank 30*a* and an inner periphery of the spring 30*b*. With this frictional load, the take-up reel 26 is rotated in the direction of arrow d in FIG. 7A to wind the ink sheet 2. If the spring 30*b* is subject to a force above a predetermined value, the spring 30*b* may slide around the external periphery of the shank 30*a* while affording the predetermined torque. Accordingly, the take-up reel 26 is always subject to a rotational force with a fixed torque. Note that the frictional load arising from the spring 30*b* subject to a rotational force in the direction of slacking is stable, as is the case with the slide clutch 29 of the supply reel 25.

In this example, a special space for providing the slide clutches 29, 30 is made unnecessary by containing the slide clutch 29 within the supply reel 25, and containing the slide clutch 30 within the take-up reel 26. Thereby, it is possible to make the arrangement of gears simpler in the design of the driving system, and accomplish the improvement of assembly. The affording of the torque to each reel 25, 26 with slide clutch 29, 30 can be achieved at one stage and any irregular transmission can be eliminated.

Further, as the clutches 29, 30 are exchanged together with the ink sheet cartridge D, it suffices if they have the durability for one volume of ink sheet. Further, as the clutches 29, 30 are simple in structure, there is the advantage that they can be fabricated at lower price than the powder clutch available on the market.

In this example, when the ink sheet 2 is taken up into the take-up reel 26, an end portion of the ink sheet 2 on the side of a base film 2*b* is pasted to the take-up reel 26*a* with a tape or the like, so that the take-up reel 26 can be rotated, with an ink applied face of the ink sheet 2 facing toward the take-up roll.

(Capstan roller)

The capstan roller 31 is a conveying roller for controlling mainly the conveyance of the ink sheet 2 by affording a conveying force to the ink sheet 2. In this example, it is contained within the ink sheet cartridge D as shown in FIG. 5, itself contributing to the accomplishment of a smaller cartridge.

This capstan roller 31 is constituted such that an external peripheral portion of a core 31*b* made of a metallic material has a smoothness (difference between irregularities arising on the surface) of about 3 μm or less, comprising a rubber portion 31*c* such as silicone rubber spray coated, and a gear 31*d* secured at an end portion of the core 31*d*. The capstan roller 31 is attached by fitting the bearings 31*a* into the U grooves 27*g*5, 27*g*6 of the frame body 27, so that it may be positioned on the base film 2*b* face side of the ink sheet 2 contained within the frame body 27. The capstan roller 31 is constituted to be in contact with the base film side 2*b* of the ink sheet 2, downstream of recording means 3 and upstream of the take-up reel 26 in the direction of conveying the ink sheet 2 (the direction of arrow b) as shown in FIG. 2, when the recording is performed by loading the ink sheet cartridge D into the recording system A. In recording, the ink sheet 2 is conveyed by the capstan roller 31 rotating in the direction of arrow e as shown in FIG. 2. In the multi-print method as in this example in which the recording is performed by conveying the recording sheet 1 and the ink sheet 2 in opposite directions, it is necessary to have a force of at least about 15 kg for conveying the ink sheet 2, when recording in all black. In this example, if the frictional coefficient between the capstan roller 31 and the base film 2*b* of the ink sheet 2 is preferably set in a range from 1.5 to 6, more preferably from 2 to 5, and most preferably from 2 to 3.5, it is possible to prevent the slippage therebetween. Note that the frictional coefficient is set at about 2.6 in this example.

A measuring method for obtaining the frictional coefficient is shown. The capstan roller 31 is secured, and an aluminum block 104 having a 50 μm thick base film of the ink sheet 2 applied on the base face is laid on an external peripheral face of the capstan roller 31. Here, the weight W of the aluminum block 104 should be in a range from 10 g to 30 g, preferably 20 g. The force F in pulling the aluminum block 104 in the horizontal direction is obtained, the frictional coefficient is calculated from F/W, and the average value of three values is adopted.

The capstan roller 31 should preferably make larger the face contact state with a thin ink sheet 2 to stabilize the conveying force which is different from that of the normal conveyance. Therefore, the surface of the capstan roller 31 is preferably excellent in the smoothness, in which the surface roughness is 5 μm or less, preferably 3 pm or less.

Figure 8:
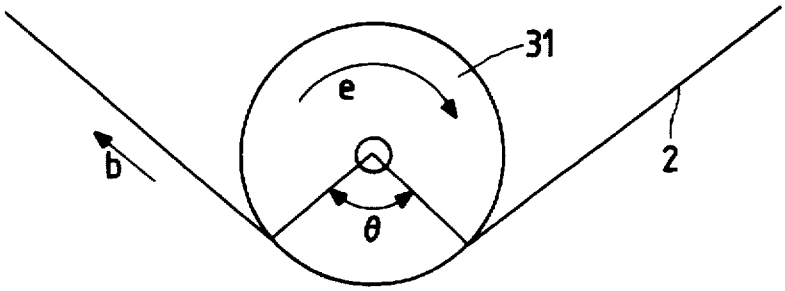
FIG. 8 is an explanation view of a drive transmission constitution.

The capstan roller 31 is less likely to slip as the contact angle θ of the ink sheet 2 relative to the capstan roller 31 as shown in FIG. 8 becomes larger. Thus, in this example, the contact angle θ is set at about 60° in a state where the ink sheet 2 is not wound at all around the take-up reel 26 (minimum roll diameter of the take-up roll). As will be seen from the FIG. 2, if the ink sheet is taken up around the take-up reel 26, increasing the diameter of the take-up roll, the contact angle θ is increased, as the ink sheet 2 is taken up with an ink face of the ink sheet 2 facing inward, and the capstan roller 31 is located in contact with the base film face side. Accordingly, the ink conveying force is surely afforded by the capstan roller 31 when the ink sheet 2 is taken up around the take-up reel 26.

Figure 9:
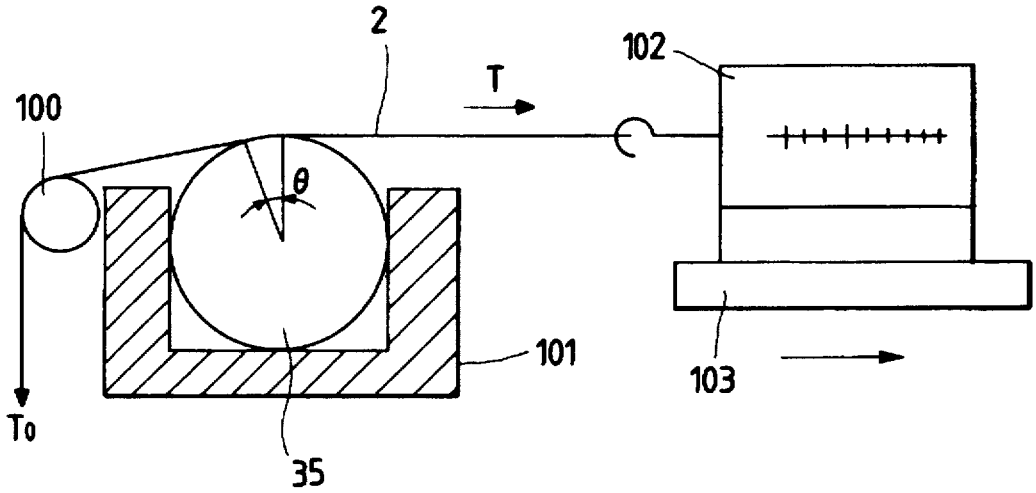
FIG. 9 is an explanation view for the experiment of obtaining the relation between a contact angle of the ink sheet to a capstan roller and a friction force.

Thus, the relation between the frictional force T and the contact angle θ in winding the ink sheet 2 around the capstan roller 31 was obtained with an experimental apparatus as shown in FIG. 9. In the actual apparatus, the force when the capstan roller 31 begins to move with the ink sheet 2 fixed is obtained, while in this experimental apparatus, the force when the ink sheet 2 begins to start with the capstan roller 31 fixed is obtained for simplicity. Note that in this experimental apparatus, the ink sheet 2 is guided along a guide shaft 100 which is fixed, and the capstan roller 31 is carried on a support member 101 in a fixed state. The frictional force T can be obtained depending on the back tension $T_o$, using a digital load meter placed on a stage 103 movable in the direction of arrow and connected at one end of the ink sheet 2.

In the experiment as shown in FIG. 9, the ink sheet 2 having a width of 60 mm (the frictional force T will be later obtained by the convention into the width of B-4 size) is wound at a contact angle θ around the capstan roller 31 having a diameter of 12 mm and a friction coefficient of about 2.4 to 2.6, and the relation between the frictional force T and the contact angle θ is obtained by changing the back tension at each value of $T_o$=116 g, 233 g, 349 g and 465 g.

As a result, it has been found that at least θ≧5° is necessary to obtain the force required for conveying the ink sheet 2 ranging from about 1.5 kg to 2 kg, when the recording is normally performed in the multi-print method in which the recording sheet 1 and the ink sheet 2 are conveyed in opposite directions.

Further, it has been found that in recording one line of all black, at least θ≧45° is necessary to obtain the force required for conveying the ink sheet, which is about 15 kg, as previously described.

On the other hand, θ≦180° is desirable as the capstan roller 13 may wrap in the ink sheet 2 if the contact angle exceeds 180°.

Accordingly, the contact angle θ is preferably in a range of 5°≦θ≦180°, more preferably a range of 45°≦θ≦180°. Further, considering an instance where paper dusts or dirts may enter between the ink sheet 2 and the capstan roller 31, it is most preferably set in a range of 55°≦θ≦180°.

Note that in this example, due to constraints on the positional relation between the capstan roller 13 and the take-up reel 26 to accomplish a smaller apparatus, θ is set to be about 60° when starting to wind the ink sheet 2, and θ is set to be about 90° when terminating to wind it. In this case, the surface of the capstan roller 31 has preferably a surface roughness of 5 μm or less, as previously described, or more preferably 3 μm or less.

If the capstan roller 31 of high friction coefficient is made in contact with the ink sheet 2 at a predetermined contact angle θ, as previously described, the conveying force can be afforded to the ink sheet 2 only by the capstan roller 31, without requiring the conventional pinch roller.

Note that to increase the conveying precision of the ink sheet 2, it is better that the rubber portion 31*c* of the capstan roller 31 is deformable as little as possible. Therefore, in this example, the rubber portion 31*c* is constituted to be thin, about 75 μm in thickness. Thereby, the roller portion of the capstan roller 31 is less likely to deform, so that the conveying precision of the ink sheet 2 can be raised.

Further, in this example, the capstan roller 31 is exchanged together with the cartridge D because the capstan roller 31 is provided within the ink sheet cartridge D. Accordingly, as the durability of the capstan roller 31 is sufficient with one volume of ink sheet, the capstan roller can be fabricated in a simpler manner.

When the capstan roller 31 is rotated at a fixed speed, the conveying amount of the ink sheet 2 depends on the roller diameter of the capstan roller 31. Accordingly, particularly in the multi-print, the recording n-value (the value of the conveying amount of the recording sheet 1 versus that of the ink sheet 2) can be easily dealt with by selecting the ink sheet cartridge D containing the capstan roller 31 having a desired roller diameter.

Note that when the capstan roller has a diameter D mm and a rotational angular velocity R rad/sec, and the conveying length rate of the ink sheet 2 in recording is l/n the conveying length rate L mm/sec of the recording sheet l in recording, the relation of D=2 L/nR will always stand among D, R, L and n. Accordingly, even with a different driving motor and driving gear (i.e., for any value of R), the ink sheet cartridge containing the capstan roller 31 having a capstan roller diameter corresponding to the recording n-value can be obtained if the relation of D=2 L/nR is satisfied.

For example, in this embodiment, the conveying length L mm/sec of the recording sheet 1 in recording is 13 mm/sec, the n-value is 5, and the conveying length of the ink sheet 2 in recording is 2.6 mm/sec. And the rotational angular velocity R rad/sec of the capstan roller 31 is 0.65 rad/sec, and the diameter D mm of the capstan roller 31 is 8 mm.

When the ink sheet cartridge containing the ink sheet with the n value of 4 is set on the recording apparatus which drives the capstan roller 31 at a rotational angular velocity of 0.65 rad/sec, it is sufficient to provide the capstan roller 31 having a diameter of 10 mm within the ink sheet cartridge. When this ink sheet cartridge is set on the recording apparatus which drives the capstan roller 31 at a rotational angular velocity of 1.30 rad/sec, it is sufficient that the diameter of the capstan roller 31 is set at 5 mm.

(Assembly of ink sheet cartridge)

In assembling the ink sheet cartridge D, a bearing 28*a* is mounted at one end of the supply reel shaft 25*a* around which the ink sheet 2 is wound as shown in FIG. 5, and fitted into a U groove 27*g*1 formed in the second body 27*b*, while a shaft 29*a* of the slide clutch 29 which has both side faces cut off is fitted into a square groove 27*b*2. Further, a bearing 28*b* is mounted at one end of a take-up reel shaft 26*a*, and fitted into a U groove 27*g*3 of the second body 27*b*, while a bearing, not shown, mounted on a shank 30*a* of the slide clutch 30 is fitted into a U groove 27*g*4. And shanks 31*a* of the capstan roller 31 are fitted into U grooves 27*g*5, 27*g*6 formed on the second body 27*b*. Next, with the first body 27*a* placed opposed to the second body 27*b*, the ink sheet cartridge D having the ink sheet 2 and the capstan roller 31 loaded therein is assembled by ultrasonic welding the weld zones 27*a*1 and 27*b*1, as well as the weld zones 27*a*4 and 27*b*6, respectively.

The ink sheet cartridge D can be loaded into a recording system A by opening a recording cover 9 in the recording system A as shown in FIG. 2, interlocking guide pins 27*f* at the foot of the cartridge with interlocking recess portions 9*a* formed in the recording cover 9, respectively, and interlocking an interlocking projection 27*b*4 at the top end of the cartridge with a latch member 33 attached on the recording cover 6.

(Recording constitution)

The recording in the recording system A can be accomplished with the thermal transfer recording by recording means 3 having the ink sheet cartridge D loaded therein, as above described.

(Recording means)

Recording means 3 will be described in the following. The recording head 3*a* used in this example is a line-type thermal head having a plurality of heat generating elements arranged in a row which can generate the heat with the energization, wherein it is rockably attached to a head supporting portion 3*c* provided on the recording cover 9 as shown in FIG. 2. Also, the recording head 3*a* is urged toward the platen roller 3*b* by a spring 3*d* disposed between the head 3*a* and the recording cover 9. And with this urging force, the recording sheet 1 and the ink sheet 2 overlapped are pressed against the platen roller 3*b*.

Fork members, not shown, are provided on both sides of the recording head 3*a* in a longitudinal direction. The fork members have a positioning feature for setting the position of the recording head 3*a* with respect to the platen roller 3*b* by engagement with the shanks 3*b*1 of platen roller 3*b* in loading the ink sheet cartridge D into the recording cover 9.

Figure 10:
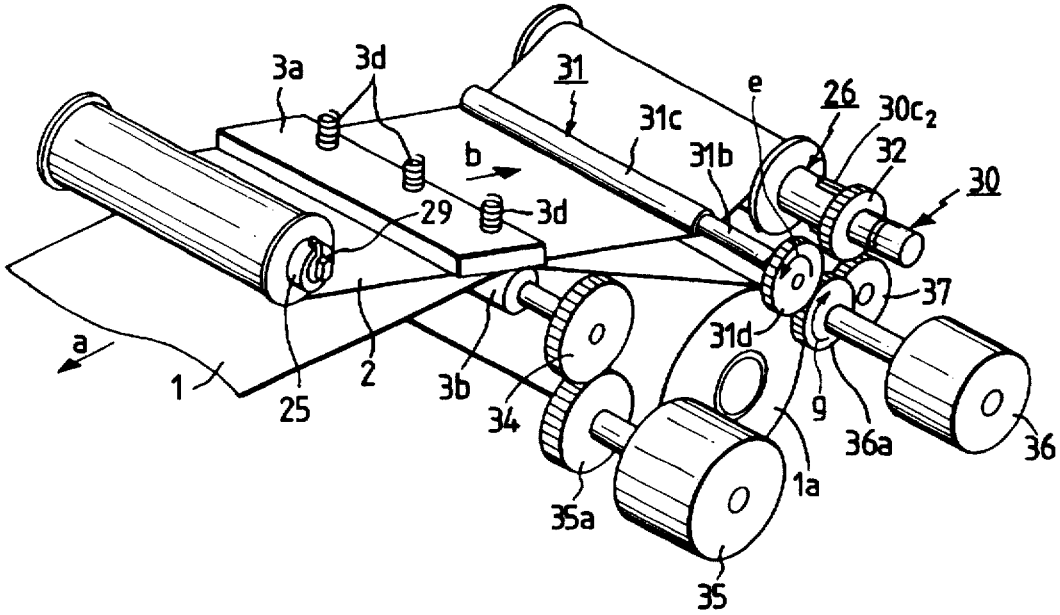
FIG. 10 is an explanation view of the drive transmission constitution.

The platen roller 3b is formed with a roller portion 3b2 longer in the axial direction than the width dimension of recording sheet 1 on the shanks 3b1 rotatably attached on the apparatus main body 6, at one end of the shank 3b1 being secured a platen gear 34 as shown in FIG. 10.

(Drive transmission constitution)

A conveyance driving mechanism for the recording sheet 1 and the ink sheet 2 will be described with reference to FIG. 10.

In FIG. 10, a platen motor 35 and an ink sheet motor 36 are mounted on the apparatus body 6. The platen motor 35 has a motor gear 35a mating with a platen gear 34, whereby the driving of the motor 35 causes a platen roller 3b to be driven for rotation, thereby conveying the recording sheet 1.

On the other hand, if the recording cover 9 having the ink sheet cartridge D loaded is closed, a gear 31d of the capstan roller 31 is mated with a motor gear 36a of the ink sheet motor 36, and a reel gear 32 of the take-up reel 26 is mated with an intermediate gear 37 mating with the motor gear 36a. Accordingly, if the ink sheet motor 36 is driven for rotation in the direction of arrow g as shown in FIG. 10, the capstan roller 31 is rotated in the direction of arrow e and the reel gear 32 is rotated in the direction of arrow d. With the rotation of the capstan roller 31, the ink sheet 2 is pulled out from the supply reel 25, and conveyed in the direction of arrow b as shown in FIG. 2. And the ink sheet 2 conveyed is taken up around the take-up reel 26.

The gear ratio has been set so that the rotational peripheral velocity of the take-up reel 26 may be not higher than that of the capstan roller 31, and the take-up reel 26 is rotated with the sliding of the slide clutch 30. And the ink sheet 2 is taken up around the take-up reel 26 while being given a front tension by the sliding.

It should be noted that by disposing the capstan roller for giving the conveying force to the ink sheet 2 near the platen roller 3b, a more accurate conveyance can be performed with a less elongation of the ink sheet 2.

(Explanation of control system)

Figure 11:
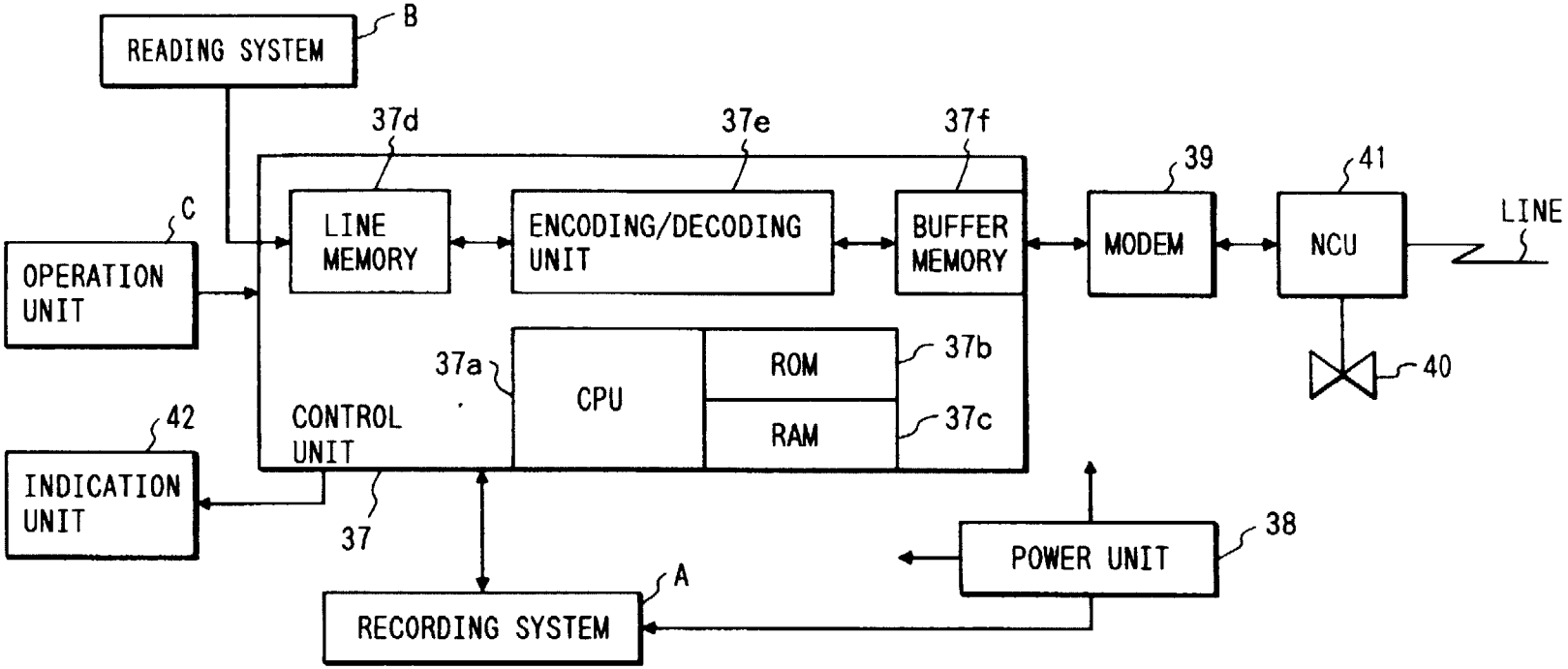
FIG. 11 is a block diagram of a control system.

Next, the control system for controlling the driving of each member will be described with reference to a block diagram as shown in FIG. 11.

In FIG. 11, 37 shows a control unit of the facsimile equipment, a power unit 38 for supplying the power to the whole apparatus, a modem substrate unit 39, NCU substrate unit 41 for the connection with a telephone set 40, and an indication unit 42 for indicating the content input from an operation panel C.

The control unit 37 has a CPU37a for controlling the whole of the recording apparatus, a ROM37b for storing various programs or data, and a RAM37c usable as the work area for temporarily storing various data such as the number of recording sheets.

37d is a line memory for storing the image of each line of an image data, in which one line of image data from an original reading system B is stored in transmitting or copying the original, while one line of decoded data is stored in receiving the image data. The image can be recorded by outputting data stored in the line memory 37d to the recording system A. 37e is an encoding/decoding unit for encoding the image information for transmission with the MH encoding, and for decoding received encoded image data for the conversion into the image data. 37f is a buffer memory for storing the encoded image data which has been received.

Figure 12:
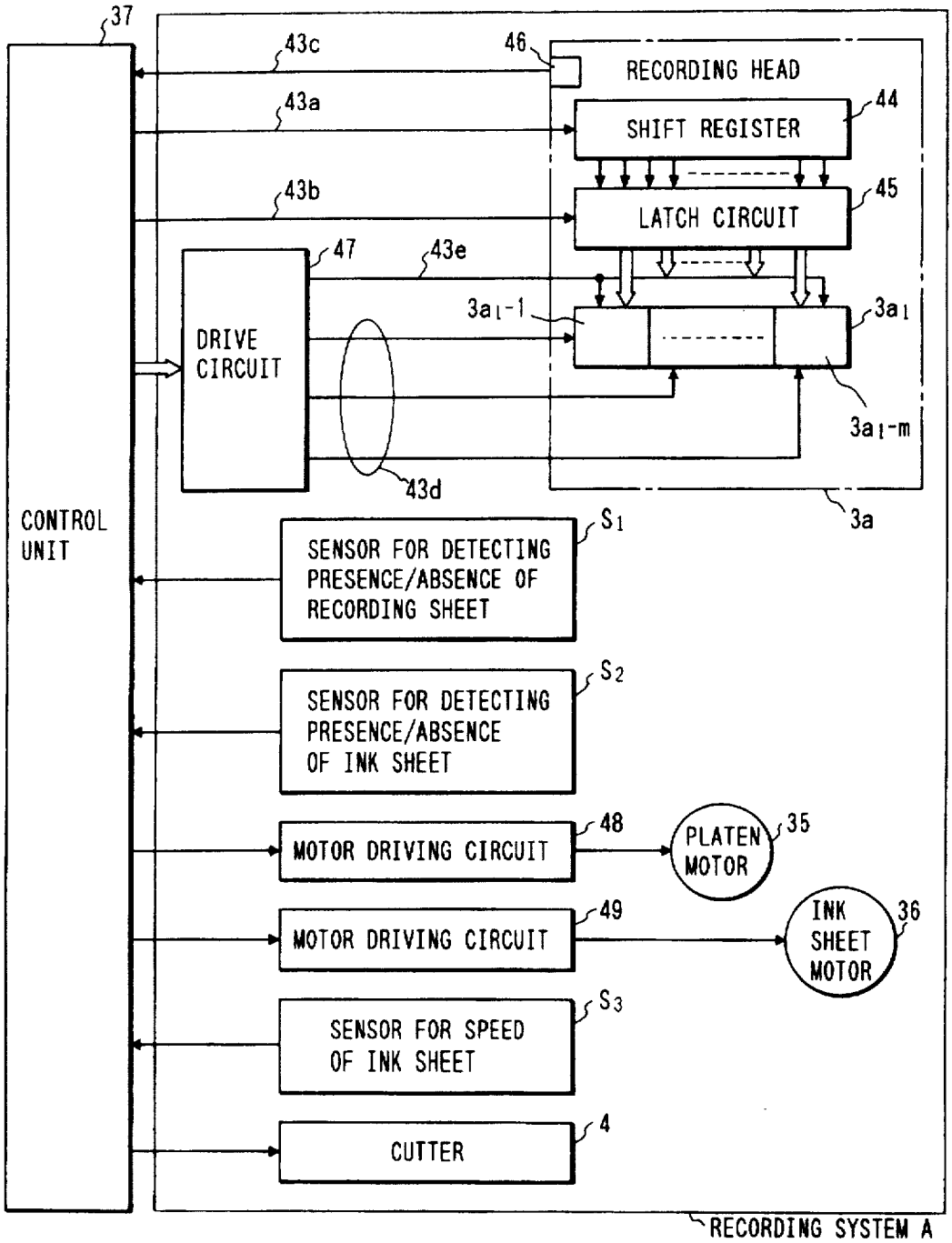
FIG. 12 is a block diagram of a recording control system.

Referring now to FIG. 12, the electrical connection between the recording system A and the control unit 37 will be described.

The recording head 3a is equipped with a shift register 44 for inputting one line of serial record data 43a from the control unit 37, a latch circuit 45 for latching data of the shift register 44 with a latch signal 43b, and a heat generating element 3a1 consisting of one line of heat generating resistors. The heat generating element 3a1 is divided into m blocks to drive. The heat generating element 3a1 is equipped with a temperature sensor 46 for detecting the temperature, the output signal 43c of which is converted from the analog to digital form within the control unit C, and input into the CPU 37a. Thereby, the CPU 37a detects the temperature of the recording head 3a, changes the pulse width of strobe signal 43d or the driving voltage of the recording head 3a in accordance with the temperature, and changes the applied energy to the recording head 3a in accordance with the characteristic of the ink sheet 2.

The kind (characteristic) of the ink sheet 2 can be selected by inputting it from the operation panel C, in which it can be determined by detecting a mark printed on the ink sheet 2. Or, it may be determined by detecting a mark or cut-out, or a projection attached to the cartridge containing the ink sheet 2.

47 is a recording head drive circuit for inputting a drive signal of the recording head 3a from the control unit 37 and outputting a strobe signal 43d for driving the recording head 3a for each block. This recording head drive circuit 47 can change the applied energy to the recording head 3a by changing the control period of the electric current to be output to a power supply line 43e for supplying the current to the heat generating element 3a 1 of the recording head 3a, in accordance with an indication of the control unit 37. 48, 49 are motor driving circuits for driving the rotation of the platen motor 35 and the ink sheet motor 36, respectively, which are driving means. Note that each motor 48, 49 is a stepping motor, but not limited to such a motor, and a DC motor or servo motor can be also used.

Further, the control unit 37 inputs a detected signal from a recording sheet sensor S1 for detecting presence/absence of the recording sheet 1, an ink sheet sensor for detecting presence/absence of the ink sheet 2, and an ink sheet speed sensor S3 for detecting the conveying speed of the ink sheet 2, displays a predetermined indication on a display unit 42 in accordance with its detected signal, and controls the recording operation.

(Recording operation)

In recording, the recording sheet 1 is conveyed in the direction of arrow a as shown in FIG. 2 by the platen roller 3b, and the ink sheet 2 is conveyed in the direction of arrow b as shown in FIG. 2 by the capstan roller 31 and taken up around the take-up reel 26.

As previously described, in the multi-print method in which the recording sheet 1 and the ink sheet 2 are conveyed in opposite directions in recording, the image is formed by shearing the ink within the ink layer. Accordingly, the conveyance of the ink sheet will require a force amounting to the frictional force between the ink sheet 2 and the recording head 3 plus a shearing force of the ink. Therefore, the conveying force of the ink sheet 2 is larger than in the conventional one-time ink sheet.

In the multi-print recording method, it is necessary for the ink sheet 2 to be surely conveyed by the amount of 1/n line every time one line of image is formed on the recording sheet 1 (recording n-value), in which the quality of recorded image can be enhanced with a reliable conveyance.

To satisfy the above condition, in this example, a highly precise, reliable conveying force is given to the ink sheet 2 by the capstan roller 31.

Other examples for each portion of the ink sheet cartridge D and the recording apparatus will be now described in the following.

In the examples as described, the so-called multi-print method was described in which the recording sheet 1 and the ink sheet 2 are conveyed in opposite directions in recording, but the one-time print method in which the recording sheet and the ink sheet are conveyed in the same direction in recording is also possible by the use of the one-time ink sheet.

Also, in the examples as described, the capstan roller 31 is constituted by spray coating silicone rubber onto a roller portion, but the coating is not necessarily limited to silicone rubber. That is, it is sufficient if the friction coefficient with the ink sheet 2 may be obtained in a previously-mentioned range, and other materials such as chloroprene rubber can be used. The method of attaching the above-mentioned material onto a core portion may be achieved by wrapping one piece of thin plate member around the core portion. Also, it may be attached by constructing a pipe member of the material and passing the core portion through the pipe. Furthermore, the rubber portion can be formed by molding.

In fabricating the thin plate, with the pipe and the mold as previously described, it is preferable to process the external peripheral face with the mirror finishing.

Next, an instance where the ink sheet cartridge of the present invention is applied to the other recording apparatus will be described below.

Figure 15:
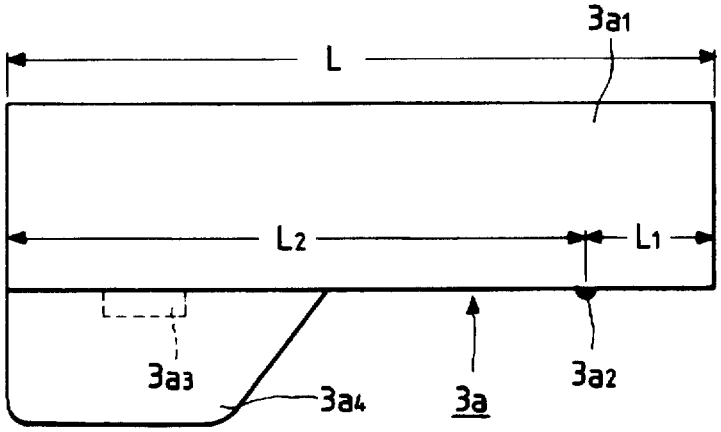
FIG. 15 is a detail view of the head constitution as shown in FIG. 13.

Recording means 3 will be described with reference to FIGS. 13 and 15. In this example, the recording head 3*a* is a line-type thermal head having a plurality of heat generating elements 3*a*2 arranged in a row on a head substrate 3*a*1, which can generate the heat with the energization, onto which heat generating element 3*a*2 are attached a head driver element 3*a*3 for the selective energization in accordance with the image signal and a protective cover 3*a*4 for surrounding and protecting the head driver element 3*a*3 over the width direction of the recording sheet 1.

The arranged position of the heat generating element 3*a*2 relative to the recording head 3*a* which is a thermal head is a position at which, assuming that the distance from the heat generating element 3*a*2 to one end of the recording head 3*a* in a direction of shorter length is L1 and the distance to the other side is L2, the relation between the distances can satisfy L1<L2 (e.g., L1=5 mm, L2=20 mm in this example).

Figure 13:
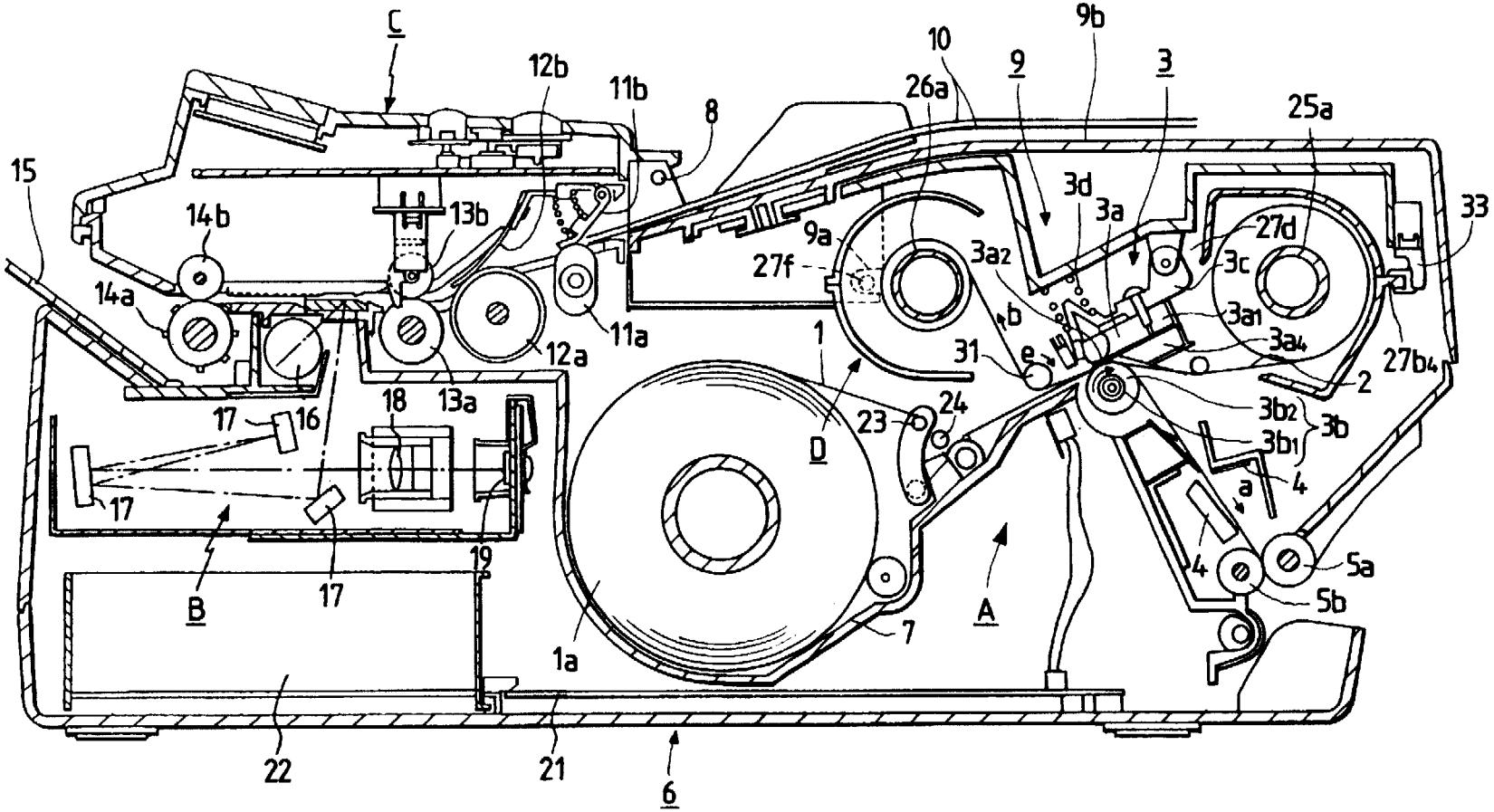
FIG. 13 is a constitutional view of a head unit in which a cartridge of the present invention is applied to another recording apparatus.

The recording head 3*a* having the heat generating elements 3*a*2 is rockably attached to a head supporting portion 3*c* provided on the recording cover 9 so that the heat generating elements 3*a*2 may be located upstream of the recording sheet 1 in the conveying direction, as shown in FIG. 13, and with the urging force of a spring 3*d* disposed between the head 3*a* and the recording cover 9, the recording sheet 1 and the ink sheet 2 overlapped are pressed against the platen roller 3*b*.

Fork members, not shown, are provided on both sides of the recording head 3*a* in a longitudinal direction. The fork members have a positioning feature for setting the position of the recording head 3*a* with respect to the platen roller 3*b* by engagement with the shanks 3*b*1 of platen roller 3*b* in loading the ink sheet cartridge D into the recording cover 9.

Figure 14A:
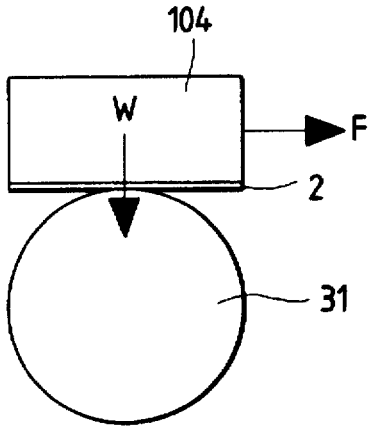
FIG. 14A is a schematic explanation view for the measurement of the friction coefficient in the present invention.
Figure 14B:
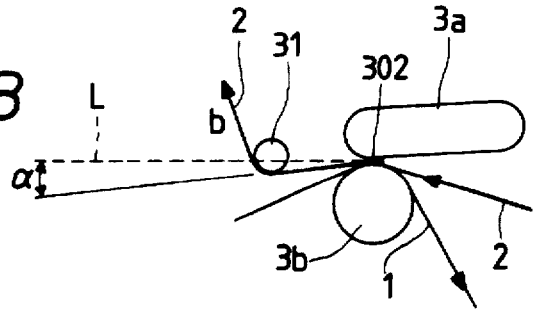
FIG. 14B is an explanation view for the conveying direction of the ink sheet in the present invention.

Note that the positional relation between the recording head 3*a*, the platen roller 3*b* and the capstan roller 31 is shown in FIG. 14B.

The capstan roller 31 is disposed such that the ink sheet 2 may have an angle α of less than 5° with respect to the direction of a tangent line L between an acting portion 3*a*2 of the recording head 3*a* on the ink sheet 2 and the platen 3*b*. With this constitution, the ink sheet after recording and the recording sheet 2 can be peeled off more securely.

With the present invention, as the rotational diameter of an ink sheet conveying rotational body provided within a cartridge frame is matched with a recording n-value of the ink sheet, the ink sheet can be conveyed at a suitable recording n-value at all times, even if the driving speed of the driving system for conveying the recording sheet and the ink sheet on the side of the recording apparatus main body is constant.

As a sensor for detecting the recording n-value of the ink sheet, and a mechanism for changing the rotational speed of the ink sheet conveying rotation body are unnecessary on the side of the apparatus body, the recording apparatus does not have a complex and large structure.

In the present invention, the ink sheet conveying member is made in contact with a supporting body of the ink sheet at a contact angle beyond a predetermined value, as previously described, the pinch roller is unnecessary unlike the conventional one, so that the number of parts and thus the cost can be reduced. Also, the ink is not peeled off to dirty the recording sheet and cause the malfunction of the apparatus.

If the ink sheet is wound with its ink face toward the inward direction of the second winding member, the contact angle of the ink sheet relative to the ink sheet conveying member is increased when the ink sheet is taken up so that the roll diameter of the second winding member is larger. Accordingly, even if the friction coefficient of the ink sheet conveying member may be small to some extent, the ink sheet can be reliably conveyed.

Furthermore, if the ink sheet conveying member is contained within the ink sheet cartridge, the ink sheet conveying member can be exchanged together with the ink sheet cartridge. Thus, there is the effect that the conveying amount of the ink sheet can be changed even in the same apparatus, and as the durability of the ink sheet conveying member is sufficient with one volume of the ink sheet, it can be fabricated more easily with a reduced cost.

In the present invention, the space for the recording apparatus main body can be reduced, and the reel gear is unnecessary on the first winding member, like the conventional one, as torque affording means for affording a rotational load to the first winding member is contained within the first winding member, as previously described, so that the number of parts and thus the cost can be reduced.

Since the back tension can be given to the ink sheet with a simple mechanism and the reduced number of parts, the occurrence of uneven image can be prevented effectively, owing to uniform transfer of the ink.

In the present invention, as torque affording means is contained within the second winding member and provided on the ink sheet cartridge side, as previously described, the space for the recording apparatus main body can be reduced, so that the recording apparatus can be assembled with an improved efficiency.

As the torque affording means can be disposed of together with the ink sheet cartridge, its durability is sufficient with one volume of the ink sheet, thereby greatly reducing the problems associated with the durability.

In the present invention, as the heat generating elements of the recording head are installed upstream of the head driver element and its protective cover in the conveying direction of the recording sheet, as previously described, the recording sheet is not placed at a certain contact angle around the platen roller to avoid the head driver element and its protective cover like the conventional one, so that the rolling tendency in waiting for the recording can be prevented. Also, a reliable conveyance of recording sheet can be achieved by preventing the occurrence of jam in which the recording sheet may be wrapped into the platen roller due to the rolling tendency of the recording sheet.

Also, with the above construction, it is possible to place the take-up reel of the ink sheet and the heat generating elements of the recording head more closely, and the material useful for the base film of the ink sheet as previously described is a polyester film, mainly a thin film having a thickness of several μm to several tens pm, so that the elongation of the ink sheet with the winding can be greatly reduced, and the reliable conveyance of the ink sheet can be achieved.

Furthermore, in the present invention, the appearance of the recording head is not changed from the conventional one, and there is no factor of increasing the cost, such as making larger a head substrate made of ceramics to separate the head driver element of the recording head and its protective cover away from the heat generating element to obtain the same effects as in the present invention.

The present invention has the effect of obtaining an ink sheet cartridge detachable from a recording apparatus having any one of a single ink sheet conveying rotational body for mainly controlling at least the conveyance of an ink sheet, torque affording means provided within a rotation shaft of a first winding member as an ink sheet supply member, and torque affording means provided within a rotation shaft of a second winding member as an ink take-up member, within the ink sheet cartridge, as previously detailed.

It will be appreciated that the present invention includes not only individual constitutions as previously described, but also any combination of individual constitutions.

What is claimed is:

1. A thermal transfer recording apparatus comprising:

a recording head for recording on a recording medium;

conveying means for conveying the recording medium;

driving means for conveying an ink sheet; and an ink sheet cartridge loadable into said recording apparatus, said ink sheet cartridge including: a first winding member for winding the ink sheet, the ink sheet being of a multi-print type having ink on a carrier and being capable of full-line recording; a second winding member for winding the ink sheet; an ink sheet conveying rotational body for affording a conveying force to the ink sheet, said ink sheet conveying rotational body being drivable by said driving means, being provided downstream of a position of said recording head with respect to a conveying direction of the ink sheet and being provided at one side of the ink sheet; and a frame body for containing the ink sheet, said first winding member, said second winding member, and said ink sheet conveying rotational body, wherein the ink sheet is wound around and taken up by said second winding member by rotation of said second winding member during recording in a direction opposite to a rotational direction of the ink sheet conveying rotational body, and wherein the ink sheet is placed in contact with an external face of said ink sheet conveying rotational body at a contact angle in a range from 5° to 180°, and wherein a relationship D=2 L/nR is satisfied, with D being a diameter in mm of said ink sheet conveying rotational body, R being an angular velocity in rad/sec of said ink sheet conveying rotational body, n being a number not less than 1, and L being a conveying length rate in mm/sec of the recording medium, and the conveying length rate of the ink sheet during recording being 1/n times L.

2. An apparatus according to claim 1, wherein said second winding member includes torque applying means.

3. An apparatus according to claim 1, wherein said first winding member includes torque applying means.

4. An apparatus according to claim 1, wherein the ink sheet is placed in contact with an external face of said ink sheet conveying rotational body at a contact angle in a range from 45° to 180°.

5. An apparatus according to claim 1, wherein the ink sheet is placed in contact with an external face of said ink sheet conveying rotational body at a contact angle in the range from 60° to 90°.

6. A thermal transfer recording method for recording on a recording sheet using a recording head and an ink sheet of a multi-print type and capable of full-line recording, contained in an ink cartridge having first and second winding members, said method comprising the steps of:

contacting an external face of an ink sheet conveying rotational body in the ink sheet cartridge to the ink sheet at a position downstream of a position of the recording head with respect to an ink sheet conveyance direction with a contact angle in a range from 5° to 180°;

driving the ink sheet conveying rotational body to convey the ink sheet; and rotating the second winding member, to take up the ink sheet, in a direction opposite to the direction of rotation of the ink sheet conveying rotational body in said driving step, wherein a relationship D=2 L/nR is satisfied, with D being a diameter in mm of said ink sheet conveying rotational body, R being an angular velocity in rad/sec of said ink sheet conveying rotational body, n being a number not less than 1, and L being a conveying length rate in mm/sec of the recording sheet, and the conveying length rate of the ink sheet during recording being 1/n times L.

7. A method according to claim 6, wherein the second winding member includes torque applying means.

8. A method according to claim 6, wherein the first winding member includes torque applying means.

9. A method according to claim 6, wherein the ink sheet is placed in contact with an external face of the ink sheet conveying rotational body at a contact angle in a range from 45° to 180°.

10. A method according to claim 6, wherein the ink sheet is placed in contact with an external face of the ink sheet conveying rotational body at a contact angle in a range from 60° to 90°.

11. A transfer thermal recording apparatus for transferring ink of an ink sheet to a recording sheet by using a full-line type thermal head having heat generating elements at an entire recording widthwise direction of the recording sheet comprising:

at least one ink sheet cartridge comprising:

a supply roll for winding an ink sheet for multi-printing, containing an ink layer capable of recording plural times on a sheet-like substrate;

a take-up roll for taking up the ink sheet supplied from said supply roll;

an ink sheet conveying rotary member for effecting a conveyance force to the ink sheet so that the ink sheet is conveyed from said supply roll to said take-up roll, said rotary member being provided on one side of said ink sheet between said thermal head and said take-up roll and having an outer diameter in accordance with a recordable number of the ink sheet, and a relationship D=2 L/nR is satisfied, with D being a diameter in mm of said ink sheet conveying rotary member, R being an angular velocity in rad/sec of said ink sheet conveying rotary member, n being a number greater than 1, and L being a conveying length rate in mm/sec of the recording sheet, and the conveying length rate of the ink sheet during recording being 1/n times L; and a cartridge housing for containing the ink sheet, said supply roll, said take-up roll, and said ink sheet conveying rotary member.

12. An apparatus according to claim 11, further comprising means for applying torque to said supply roll.

13. An apparatus according to claim 11, further comprising means for applying torque to said take-up roll.

14. An apparatus according to claim 11, an external face of said rotary member contacting the ink sheet at a position downstream of a position of the thermal head with respect to an ink sheet conveyance direction with a contact angle in a range from 5° to 180°.

15. An apparatus according to claim 11, the ink sheet contacting an external face of said rotary member at a contact angle in a range from 45° to 180°.

16. An apparatus according to claim 11, in which conveyance of the ink sheet effected by the conveyance force from said ink sheet conveying rotary member satisfies a relationship D=2 L/nR, with D being a diameter in mm of said rotary member, R being an angular velocity in rad/sec of said rotary member, n being a natural number greater than 1, and L being a conveying length rate in mm/sec of a recording sheet, and the conveying length rate of the ink sheet during recording is 1/n times L.

17. An apparatus according to claim 11, the ink sheet contacting an external face of said rotary member at a contact angle in a range from 60° to 90°.

18. An ink sheet cartridge loadable into a recording apparatus which records onto a recording sheet with a recording head, said ink sheet cartridge comprising:

a first winding member for winding an ink sheet, the ink sheet being of a multi-print type having ink on a carrier, and being capable of full-line recording;

a second winding member for winding the ink sheet;

an ink sheet conveying rotational body for affording a conveying force to the ink sheet, said ink sheet conveying rotational body being drivable by drive means in the recording apparatus, said ink sheet conveying rotational body being provided downstream of a position of the recording head in the recording apparatus with respect to a conveying direction of the ink sheet, said ink sheet conveying rotational body being provided at one side of the ink sheet;

a frame for containing the ink sheet, said first winding member, said second winding member, and said ink sheet conveying rotational body, wherein the ink sheet is wound around and taken up by said second winding member by rotation of said second winding member during recording in a direction opposite to a rotational direction of the ink sheet conveying rotational body, and wherein the ink sheet is placed in contact with an external face of said ink sheet conveying rotational body at a contact angle in a range from 5° to 180°, and wherein a relationship D=2 L/nR is satisfied, with D being a diameter in mm of said ink sheet conveying rotational body, R being an angular velocity in rad/sec of said ink sheet conveying rotational body, n being a number greater than 1, and L being a conveying length rate in mm/sec of the recording sheet, and the conveying length rate of the ink sheet during recording being 1/n times L.

19. An ink sheet cartridge according to claim 18, said second winding member comprising torque comprising means.

20. An ink sheet cartridge according to claim 18, said first winding member comprising torque applying means.

21. An ink sheet cartridge according to claim 18, wherein the ink sheet is placed in contact with an external face of said ink sheet conveying rotational body at a contact angle in a range from 45° to 180°.

22. An ink sheet cartridge according to claim 18, wherein the ink sheet is placed in contact with an external face of said ink sheet conveying rotational body at a contact angle in a range from 60° to 90°.

* * * * *

UNITED STATES PATENT AND TRADEMARK OFFICE

CERTIFICATE OF CORRECTION

PATENT NO. : 5,800,084

DATED : September 1, 1998

INVENTOR(S) : Sawada et al.

It is certified that error appears in the above-identified patent and that said Letters Patent is hereby corrected as shown below:

COLUMN 1:

Line 22, "thermosenstive" should read --thermosensitive--;
Line 62, "have" should read --has--; and
Line 66, "etc.,)" should read --etc.)--.

COLUMN 6:

Line 1, "explanation-view" should read --explanation view--; and
Line 37, a new paragraph should begin with "(General".

COLUMN 8:

Line 1, "being is" should read --being--.

COLUMN 9:

Line 56, "27bis" should read --27b is--; and
Line 60, "27bare" should read --27b are--.

COLUMN 10:

Line 7, "27a 2" should read --27a2--.

UNITED STATES PATENT AND TRADEMARK OFFICE

CERTIFICATE OF CORRECTION

PATENT NO. : 5,800,084 Page 2 of 2

DATED : September 1, 1998

INVENTOR(S) : Sawada et al.

It is certified that error appears in the above-identified patent and that said Letters Patent is hereby corrected as shown below:

COLUMN 15:

Line 47, "CPU37a" should read --CPU 37a--;
Line 48, "ROM37b" should read --ROM 37b--;
Line 49, "RAM37c" should read --RAM 37c--; and
Line 58, "37e" should start as a new paragraph.

COLUMN 16:

Line 28 , "48," should start as a new paragraph.

COLUMN 19:

Line 6, "pm," should read --μm,--.

COLUMN 20:

Line 9, "in the" should read --in a--.

Signed and Sealed this

Twenty-fifth Day of May, 1999

*Attest:*

Q. TODD DICKINSON

*Attesting Officer*

*Acting Commissioner of Patents and Trademarks*